US010520867B2

(12) United States Patent
Tamada et al.

(10) Patent No.: US 10,520,867 B2
(45) Date of Patent: Dec. 31, 2019

(54) IMAGE FORMING APPARATUS

(71) Applicant: KONICA MINOLTA, INC., Chiyoda-ku, Tokyo (JP)

(72) Inventors: Takeshi Tamada, Toyohashi (JP); Hiroaki Takatsu, Nishio (JP); Takahiro Tsujimoto, Toyokawa (JP); Tianhua Xu, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/113,411

(22) Filed: Aug. 27, 2018

(65) Prior Publication Data

US 2019/0079435 A1 Mar. 14, 2019

(30) Foreign Application Priority Data

Sep. 11, 2017 (JP) ..... 2017-174059

(51) Int. Cl.
*G03G 15/20* (2006.01)
*G03G 15/00* (2006.01)

(52) U.S. Cl.
CPC ..... *G03G 15/205* (2013.01); *G03G 15/80* (2013.01)

(58) Field of Classification Search
CPC .. G03G 15/205; G03G 15/80; G03G 15/2053; G03G 15/5004; G03G 15/2078; H02M 3/155; H02M 7/46
See application file for complete search history.

(56) References Cited

U.S. PATENT DOCUMENTS

2005/0117923 A1* 6/2005 Sasamoto ..... G03G 15/2039 399/45
2008/0044196 A1* 2/2008 Seo ..... G03G 15/2039 399/69
2012/0250058 A1* 10/2012 Tamada ..... G06F 3/1221 358/1.13
2014/0363185 A1* 12/2014 Tamada ..... G03G 15/2028 399/68
2016/0124356 A1* 5/2016 Tamada ..... G03G 15/2039 399/70
2017/0176904 A1* 6/2017 Kimura ..... G03G 15/2039
2017/0261892 A1* 9/2017 Aoki ..... G03G 15/205
2017/0371276 A1* 12/2017 Kato ..... G03G 15/205
2018/0267447 A1* 9/2018 Kato ..... G03G 15/2039
2018/0335731 A1* 11/2018 Ogura ..... G03G 15/205
2018/0335821 A1* 11/2018 Kamiya ..... H04N 1/00244

FOREIGN PATENT DOCUMENTS

JP 10333490 A 12/1998
JP 2002072726 A 3/2002
JP 2017044954 A 3/2017

* cited by examiner

*Primary Examiner* — Francis C Gray
(74) *Attorney, Agent, or Firm* — Buchanan Ingersoll & Rooney PC

(57) ABSTRACT

An image forming apparatus includes a heater, a first heater drive circuit which rectifies AC power from an AC power supply and subjects a current to be conducted to the heater to PWM control, and a second heater drive circuit which allows conduction from the AC power to the heater. The image forming apparatus further includes a switching circuit which sets a drive circuit which is to drive the heater to any one of the first heater drive circuit and the second heater drive circuit and a control unit which controls switching between the drive circuits by the switching circuit.

18 Claims, 12 Drawing Sheets

FIG.5

| OPERATION MODE | REQUESTED PERFORMANCE | SELECTED CIRCUIT | |
|---|---|---|---|
| | | FIRST CIRCUIT | SECOND CIRCUIT |
| SLEEP | – | – | – |
| WARM-UP | INDICATED POWER MAX (100%)<br>REDUCTION IN WT WITH POWER EFFICIENCY BEING ENHANCED | | ○ |
| STAND-BY | INDICATED POWER LOW Duty (0 TO 50%)<br>REDUCTION IN TEMPERATURE RIPPLE | ○ | |
| PRINTING | INDICATED POWER HIGH Duty (50 TO 100%)<br>REDUCTION IN TEMPERATURE RIPPLE<br>STABILIZATION OF POWER CONTROL | ○ | |

FIG.9

| Duty | OPERATION MODE | SELECTED CIRCUIT | | REMARKS |
|---|---|---|---|---|
| | | FIRST CIRCUIT | SECOND CIRCUIT | |
| Duty0% | – | – | – | – |
| Duty100% | WARM-UP | | ○ | |
| Duty50~80% | PRINTING MODE(NORMAL) | ○ | | |
| Duty0~50% | STAND-BY MODE(NORMAL) | ○ | | |
| Duty 100⇔95% SWITCH | MODE OF SUCCESSIVE COLOR PRINTING ON CARDBOARD IN EXTREMELY LOW TEMPERATURE ENVIRONMENT | ○ | | SELECT FIRST CIRCUIT REGARDLESS OF Duty DURING SUCCESSIVE PRINTING |
| Duty 100⇔95% SWITCH | CONTINUOUS STAND-BY IN EXTREMELY LOW-TEMPERATURE ENVIRONMENT | ○ | | SELECT FIRST CIRCUIT REGARDLESS OF Duty DURING CONTINUOUS STAND-BY |
| Duty 100⇔0% SWITCH | CONTINUOUS STAND-BY (ENERGY SAVING BEING PRIORITIZED/TIME FOR RECOVERY FROM STAND-BY BEING ALLOWED TO SOME EXTENT) | | ○ | |

FIG.10

| DETECTED TEMPERATURE | OPERATION MODE | WU COMPLETION TEMPERATURE | SELECTED CIRCUIT | |
|---|---|---|---|---|
| | | | FIRST CIRCUIT | SECOND CIRCUIT |
| 30 | MONOCHROME PRINTING | 180 | | ○ |
| 90 | MONOCHROME PRINTING | 180 | | ○ |
| 150 | MONOCHROME PRINTING | 180 | | ○ |
| 160 | MONOCHROME PRINTING | 180 | | ○ |
| 170 | MONOCHROME PRINTING | 180 | ○ | |
| 180 | MONOCHROME PRINTING | 180 | ○ | |
| 30 | COLOR PRINTING | 200 | | ○ |
| 90 | COLOR PRINTING | 200 | | ○ |
| 150 | COLOR PRINTING | 200 | | ○ |
| 160 | COLOR PRINTING | 200 | | ○ |
| 170 | COLOR PRINTING | 200 | ○ | |
| 180 | COLOR PRINTING | 200 | ○ | |

FIG.11

| DETECTED TEMPERATURE | OPERATION MODE | WU COMPLETION TEMPERATURE | WU-COMPLETION-DETECTED TEMPERATURE | SELECTED CIRCUIT | |
|---|---|---|---|---|---|
| | | | | FIRST CIRCUIT | SECOND CIRCUIT |
| 30 | MONOCHROME PRINTING | 180 | 150 | | ○ |
| 90 | MONOCHROME PRINTING | 180 | 90 | | ○ |
| 150 | MONOCHROME PRINTING | 180 | 30 | | ○ |
| 160 | MONOCHROME PRINTING | 180 | 20 | | ○ |
| 170 | MONOCHROME PRINTING | 180 | 10 | ○ | |
| 180 | MONOCHROME PRINTING | 180 | 0 | ○ | |
| 190 | MONOCHROME PRINTING | 180 | −10 | ○ | |
| 30 | COLOR PRINTING | 200 | 170 | | ○ |
| 90 | COLOR PRINTING | 200 | 110 | | ○ |
| 150 | COLOR PRINTING | 200 | 50 | | ○ |
| 160 | COLOR PRINTING | 200 | 40 | | ○ |
| 170 | COLOR PRINTING | 200 | 30 | | ○ |
| 180 | COLOR PRINTING | 200 | 20 | | ○ |
| 190 | COLOR PRINTING | 200 | 10 | ○ | |

IMAGE FORMING APPARATUS

The entire disclosure of Japanese Patent Application No. 2017-174059 filed on Sep. 11, 2017 is incorporated herein by reference in its entirety.

BACKGROUND

Technological Field

This invention relates to an image forming apparatus and particularly to an image forming apparatus including a heater.

Description of the Related Art

Japanese Laid-Open Patent Publication No. 2017-044954 describes a conventional image forming apparatus of an electrophotography type. In the image forming apparatus described in Japanese Laid-Open Patent Publication No. 2017-044954, a switch for short-circuiting is provided in a filter portion of a heater driven by an alternating-current (AC) power supply, and whether or not to cause short-circuiting can be selected in the filter portion depending on a state of power control (phase control). An image forming apparatus described in Japanese Laid-Open Patent Publication No. 10-333490 determines which of a 200-V system and a 100-V system is to be used as a voltage of an AC power supply and switches between voltage doubler rectification and full-wave rectification with a triac in accordance with a result of determinatio.

An image forming apparatus described in Japanese Laid-Open Patent Publication No. 2002-072726 is configured to include three ceramic heaters and to supply one ceramic heater with power from dedicated first power supply means and supply two other ceramic heaters with power from common second power supply means. In the image forming apparatus described in Japanese Laid-Open Patent Publication No. 2002-072726, in order to prevent lowering in temperature of a fixation apparatus in switching between the two other ceramic heaters, power is supplied by the first power supply means to one ceramic heater when the second power supply means is turned off.

In an image forming apparatus, a heater embedded in a fixation portion is activated when an image is to be fixed. A simple heater drive circuit which activates a heater by turning on and off AC power from an AC power supply, a phase-controlled heater drive circuit which activates a heater by controlling a phase of AC power from an AC power supply, and a PWM-controlled heater drive circuit which activates a heater by converting AC power from an AC power supply into direct current (DC) by a rectifier circuit and controlling power to be supplied with a high-speed switching element have been known as heater drive circuits which activate a heater. The PWM-controlled heater drive circuit is advantageous in that it can more highly accurately control power to be supplied to the heater than the simple heater drive circuit and it is higher in power factor and power efficiency and can suppress generation of noise more than the phase-controlled heater drive circuit.

The PWM-controlled heater drive circuit, however, requires high-frequency chopping, and hence it is disadvantageous in that a noise filter circuit as measures against noise increases in size and a power loss in a full-wave rectifier circuit and a switching element is caused. In particular, in the PWM-controlled heater drive circuit, even in such a situation that highly accurate power control is not required and 100% power is applied to a heater in a warm-up mode after turn-on of power or recovery from sleep, a power loss in the full-wave rectifier circuit and the switching element is inevitably caused. Therefore, when any one type of the heater drive circuits is adopted as in the image forming apparatuses described in Japanese Laid-Open Patent Publications Nos. 2017-044954, 10-333490, and 2002-072726, the disadvantage of the adopted heater drive circuit is inevitably caused.

One object of the present technique is to provide an image forming apparatus including a heater configured to reduce the drawback of a heater drive circuit.

SUMMARY

To achieve at least one of the abovementioned objects, according to an aspect of the present invention, an image forming apparatus reflecting one aspect of the present invention comprises a heater, a first heater drive circuit which rectifies AC power from an AC power supply and subjects a current to be conducted to the heater to PWM control, a second heater drive circuit which conducts AC power to the heater, a switching circuit which switches a drive circuit which is to drive the heater to any one of the first heater drive circuit and the second heater drive circuit, and a control unit which controls switching between the drive circuits by the switching circuit.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 5 is a diagram for illustrating relation between an operation mode, requested performance, and a selected drive circuit.

FIG. 9 is a diagram for illustrating switching between the heater drive circuits based on a duty ratio of indicated power.

FIG. 10 is a diagram for illustrating switching between the heater drive circuits based on a detected temperature of the heater.

FIG. 11 is a diagram for illustrating switching between the heater drive circuits based on a difference between a detected temperature of the heater and a warm-up completion temperature.

DETAILED DESCRIPTION OF EMBODIMENTS

Figure 1:
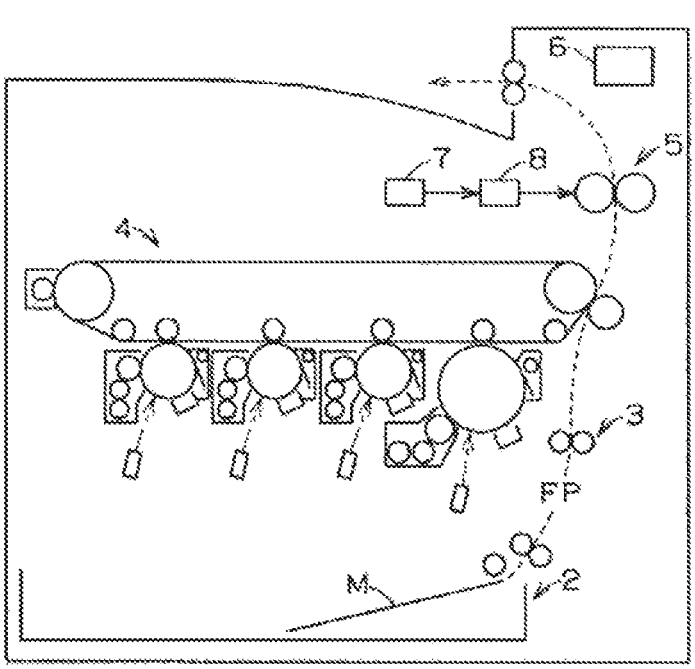
FIG. 1 is a diagram showing an overall construction of an image forming apparatus.

Hereinafter, one or more embodiments of the present invention will be described with reference to the drawings. However, the scope of the invention is not limited to the disclosed embodiments.

Embodiment

An embodiment of the present invention will be described in detail with reference to the drawings. The same or corresponding elements in the drawings have the same reference characters allotted and description thereof will not be repeated.

Figure 2:
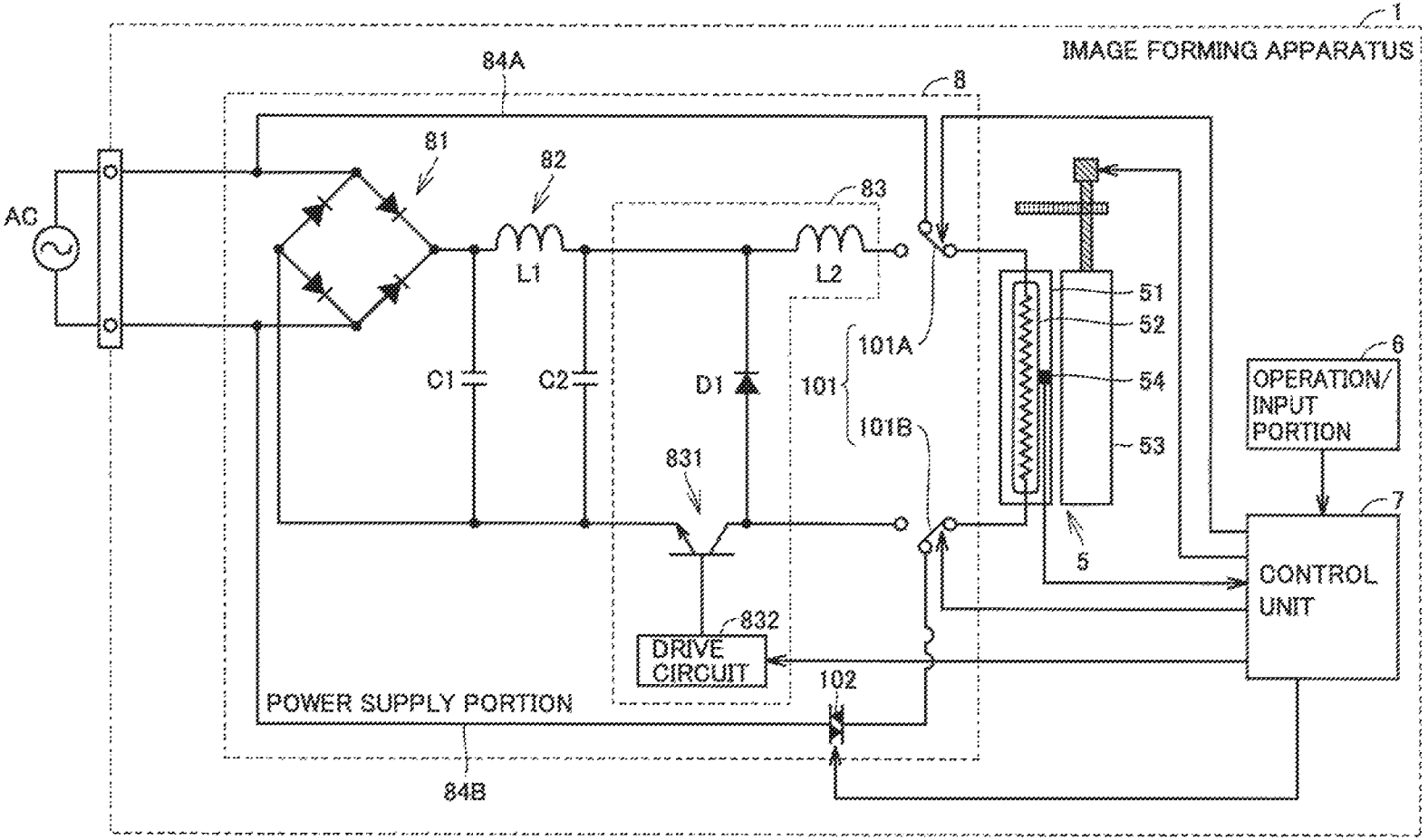
FIG. 2 is a diagram showing a main portion of the image forming apparatus.

FIG. 1 is a diagram showing an overall construction of an image forming apparatus 1. FIG. 2 is a diagram showing a main portion of image forming apparatus 1. Image forming apparatus 1 is implemented, for example, by a copying machine, a printer, or a facsimile, or a multi-functional peripheral including functions of these apparatuses, and prints an image on a printing medium M (for example, paper) in a form of a sheet. To that end, image forming apparatus 1 generally includes a paper feed portion 2, a registration roller pair 3, an image forming portion 4, a fixation portion 5, an operation/input portion 6, a control unit 7, and a power supply portion 8. An operation by each feature during a printing operation by image forming apparatus 1 will be described below.

Paper feed portion 2 carries printing medium M. Paper feed portion 2 sends printing medium M one by one to a transport path FP shown with a dashed line in FIG. 1. Registration roller pair 3 is provided on transport path FP on a downstream side of paper feed portion 2. Registration roller pair 3 once stops printing medium M sent from paper feed portion 2 and thereafter sends the printing medium to a secondary transfer region at prescribed timing.

Image forming portion 4 generates a toner image on an intermediate transfer belt, for example, with an electrophotography scheme and a tandem scheme which are well known. Such a toner image is carried on the intermediate transfer belt and transported to the secondary transfer region.

To the secondary transfer region, printing medium M is sent from registration roller pair 3 and a toner image is transported from image forming portion 4. In the secondary transfer region, the toner image is transferred from the intermediate transfer belt to printing medium M.

In fixation portion 5, a heating roller 51 and a pressurization roller 53 abut on each other to form a nip. Heating roller 51 contains a heater 52 in a cylindrical core. Heater 52 is implemented, for example, by a halogen heater and driven by a current supplied by power supply portion 8. Pressurization roller 53 rotates under the control by control unit 7. Heating roller 51 rotates as following rotation of pressurization roller 53. When printing medium M is sent into the nip, printing medium M is pressurized by pressurization roller 53 and heated by heating roller 51. Consequently, toner is fixed onto printing medium M. Thereafter, printing medium M is sent toward a paper ejection tray.

Fixation portion 5 further includes a temperature detection portion 54 implemented, for example, by a thermistor. Temperature detection portion 54 detects a temperature of heater 52 and outputs a result of detection to control unit 7.

Operation/input portion 6 includes a numeric keypad or a touch pad. A user operates operation/input portion 6 to enter various types of information.

In control unit 7, a CPU executes a program stored in a ROM by using a RAM as a work area. Though control by control unit 7 is various, what is important in the present embodiment is control of power conduction to heater 52. Specifically, control unit 7 switches between direct supply of a current from power supply portion 8 to heater 52 and supply of a current from power supply portion 8 to heater 52 under PWM control such that a result of detection by temperature detection portion 54 efficiently indicates a target temperature.

Power supply portion 8 is a feature which is connected to a commercial power supply (AC power supply) and supplies power to heater 52. Specifically, as shown in FIG. 2, power supply portion 8 includes a rectifier circuit 81, a noise filter 82, a chopper circuit 83, AC lines 84A and 84B, and a switching circuit 101. Initially, rectifier circuit 81 is connected to the commercial power supply.

Noise filter 82 is implemented, for example, by a $\pi$ filter and cascaded to an output side of rectifier circuit 81. Specifically, noise filter 82 includes a coil L1 and capacitors C1 and C2. Coil L1 is connected in series to heater 52 and capacitors C1 and C2 are connected in parallel to heater 52.

Chopper circuit 83 is implemented, for example, by a step-down chopper circuit and cascaded to an output side of noise filter 82. In this case, chopper circuit 83 includes a coil (reactor) L2, a freewheeling element D1, a switching element 831, and a drive circuit 832.

Coil L2 is connected in series between coil L1 and heater 52. Freewheeling element D1 is implemented, for example, by a diode and connected in parallel to heater 52 on a side of noise filter 82 relative to coil L1. More specifically, freewheeling element D1 is arranged such that a cathode of freewheeling element D1 is electrically connected between L1 and L2 and an anode thereof is electrically connected between heater 52 and a collector of switching element 831.

Switching element 831 is implemented, for example, by an insulated gate bipolar transistor (IGBT) or a metal-oxide-semiconductor field-effect transistor (MOS-FET), and connected in series to heater 52 on a side of noise filter 82 relative to freewheeling element D1. More specifically, switching element 831 is arranged such that the collector of switching element 831 is electrically connected to heater 52 and an emitter thereof is electrically connected to the output side of rectifier circuit 81. Drive circuit 832 is connected to a gate of switching element 831 and sets a duty ratio and a drive frequency in PWM control of switching element 831 under the control by control unit 7. Heater 52 is connected between output terminals of chopper circuit 83 as set forth above.

Power supply portion 8 is further provided with AC lines 84A and 84B which directly connect the commercial power supply and heater 52 to each other for allowing direct supply of AC power of the commercial power supply to heater 52. AC lines 84A and 84B directly connect the commercial power supply and heater 52 to each other without going through rectifier circuit 81, noise filter 82, and chopper circuit 83.

Switching circuit 101 for changing a destination of connection of heater 52 between chopper circuit 83 and AC lines 84A and 84B is provided. Switching circuit 101 is provided at each of opposing ends of heater 52 and implemented by a switch 101A on a side of connection to AC line 84A and a switch 101B on a side of connection to AC line 84B. Switching by switch 101A and switch 101B is controlled by control unit 7.

A triac 102 is provided in AC line 84B. Triac 102 sets whether or not to supply AC power of the commercial power supply to heater 52 when heater 52 is connected to AC lines 84A and 84B by switching circuit 101. Switching by triac 102 is controlled by control unit 7.

Power supply portion 8 is provided with a circuit (a first heater drive circuit) which is configured with rectifier circuit 81, noise filter 82, and chopper circuit 83 to rectify AC power from the commercial power supply and subject a current to be conducted to heater 52 to PWM control, and a circuit (a second heater drive circuit) which is configured with AC lines 84A and 84 and triac 102 to allow conduction from the commercial power supply to heater 52. Power supply portion 8 is further provided with switching circuit 101 for switching between these circuits.

Therefore, image forming apparatus 1 has such a circuit configuration as being able to switch as appropriate between the PWM-controlled heater drive circuit (first heater drive circuit) which activates the heater by converting AC power from the commercial power supply into DC power with the rectifier circuit and controlling power to be supplied with a high-speed switching element and the simple control heater drive circuit (second heater drive circuit) which activates the heater simply by turning on and off AC power from the commercial power supply.

Figure 3:
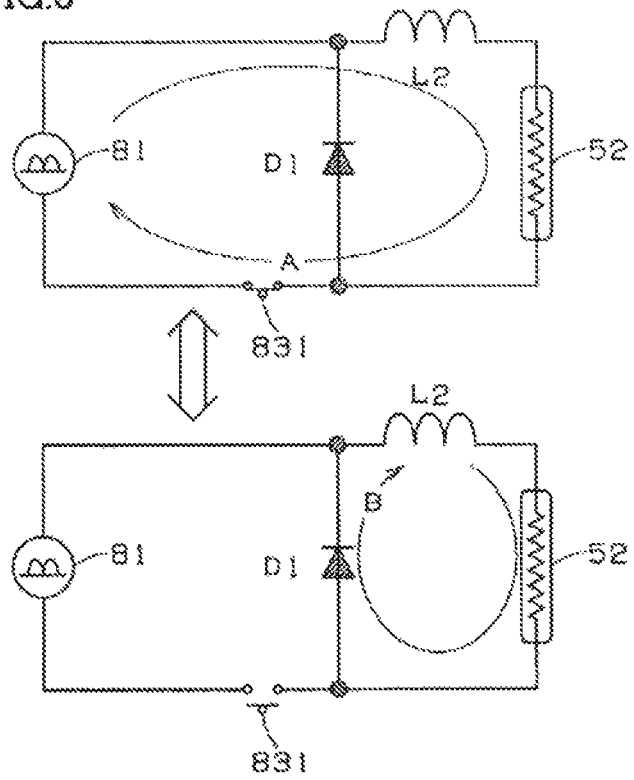
FIG. 3 is a diagram showing in an upper half, a current which flows through a heater while a switching element is turned on and shows in a lower half, a current while the switching element is turned off.
Figure 4:
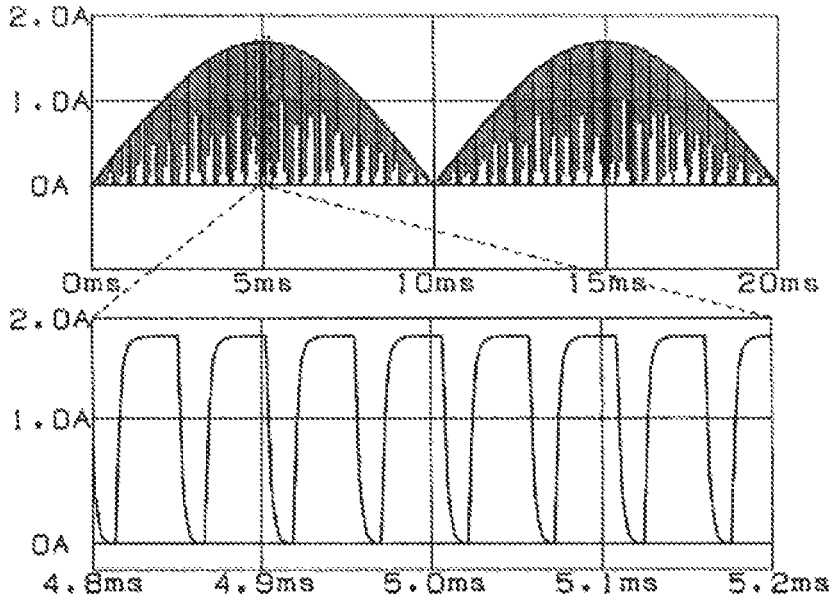
FIG. 4 is a diagram showing one example of a waveform of a current which flows through the heater.

Drive by the first heater drive circuit will initially be described. FIG. 3 is a diagram showing in an upper half, a current which flows through heater 52 while switching element 831 is turned on and shows in a lower half, a current while switching element 831 is turned off. FIG. 4 is a diagram showing one example of a waveform of a current which flows through heater 52. Initially, rectifier circuit 81 generates a DC current by subjecting an AC current supplied from the commercial power supply to full-wave rectification. Noise filter 82 removes noise from the current output from rectifier circuit 81. Capacitors C1 and C2 of noise filter 82 prevent a high-frequency component of a pulsed current which flows through switching element 831 from leaking toward the commercial power supply.

In supplying power to heater 52, a control signal indicating at least a time segment (that is, a duty ratio) during which heater 52 should be turned on is input from control unit 7 to drive circuit 832. Drive circuit 832 generates a drive signal for turning on and off switching element 831 at a duty ratio under PWM control indicated by the input control signal and supplies the drive signal to the gate of switching element 831. Switching element 831 is driven at a frequency (for example, 20 kHz) much higher than a frequency of the commercial power supply.

When switching element 831 is turned on, as shown with an arrow A in the upper half in FIG. 3, a DC current generated by rectifier circuit 81 flows through switching element 831 to coil L2 and heater 52. During this period, coil L2 stores some of the DC current which flows therethrough as magnetic energy.

When switching element 831 is turned off, as shown with an arrow B in the lower half in FIG. 3, magnetic energy stored in coil L2 while switching element 831 was turned on is released as a current and starts to flow through heater 52. This current returns to coil L2 through freewheeling element D1 as a regenerative diode. Owing to operations by power supply portion 8 as above, a waveform of the current input to heater 52 is closer to a sinusoidal wave as shown in FIG. 4. A power factor of power supply portion 8 is thus improved and a harmonic current in the input current is decreased.

Drive by the second heater drive circuit will now be described. The second heater drive circuit directly supplies the commercial power supply to heater 52 without subjecting the commercial power supply to full-wave rectification. Since short-circuiting between the first heater drive circuit and the second heater drive circuit causes short-circuiting on a primary side (a side of the commercial power supply), switching circuit 101 is configured to switch between the first heater drive circuit and the second heater drive circuit under an exclusive condition without fail. Switching circuit 101 is essentially configured, for example, to connect only any one circuit to a common contact as in a dual-circuit C contact (transfer contact) scheme in a relay circuit.

The first heater drive circuit achieves highly accurate power control by subjecting an AC current to full-wave rectification by rectifier circuit 81, removing noise in the current subjected to full-wave rectification with noise filter 82, and thereafter subjecting switching element 831 to PWM control at a high frequency at approximately 20 kHz. The first heater drive circuit, however, has to carry out high-frequency chopping control, and therefore it is disadvantageous in that generation of noise is likely therein, a high-capacity capacitor is required as a capacitor to be included in a filter as measures against noise, and power efficiency becomes poor due to lowering in voltage in rectifier circuit 81 and a power loss in switching element 831.

On the other hand, the second heater drive circuit is high in power efficiency because it can only select whether or not to supply an AC current to heater 52 by controlling triac 102 and hence a power loss can be suppressed to only a power loss in triac 102 while an AC current is supplied. The second heater drive circuit, however, can only make selection as to whether or not to supply an AC current to heater 52, and hence it is disadvantageous in its inability of highly accurate power control.

In image forming apparatus 1, performance requested for a heater drive circuit is different depending on an operation mode. Therefore, influence by the drawback of each heater drive circuit is lessened by switching between heater drive circuits which are to drive the heater in accordance with an operation mode. FIG. 5 is a diagram for illustrating relation between an operation mode, requested performance, and a selected heater drive circuit. FIG. 5 shows an example in which the operation mode of image forming apparatus 1 is broadly categorized into three modes of a warm-up (WU) mode, a stand-by mode, and a printing mode (image formation mode). The warm-up mode refers to an operation mode in which heater 52 is activated rapidly to a certain temperature when a temperature of heater 52 is low, for example, after turn-on of power or recovery from sleep. The stand-by mode refers to an operation mode in which heater 52 is activated to maintain a stand-by temperature while power consumption is suppressed. The printing mode refers to an operation mode for activating heater 52 so as to maintain a temperature required for fixation (fixation temperature). The stand-by temperature may be equal to or lower than the fixation temperature.

In the warm-up mode, completion of heating by the operation mode in a short period of time is desired. Therefore, performance requested of the heater drive circuit is power control at maximum (MAX) power (at a duty ratio of 100% in PWM control) of power indicated by control unit 7 to power supply portion 8 (indicated power). In the warm-up mode, the heater drive circuit is desired to be shorter in warm-up time period (WT) by enhancing power efficiency. Therefore, in the warm-up mode, the second heater drive circuit (second circuit) is selected as the heater drive circuit.

In the stand-by mode, stabilization of a time period until start of printing is desired. Therefore, performance requested of the heater drive circuit is control at low indicated power (at a low duty ratio (0 to 50%) in PWM control) so as to lessen a temperature ripple of a stand-by temperature with variation in environment. Therefore, in the stand-by mode, the first heater drive circuit (first circuit) is selected as the heater drive circuit. When a time period until start of printing does not matter in the stand-by mode, the second heater drive circuit may be selected as the heater drive circuit in consideration of power efficiency.

In the printing mode, stabilization of a fixation temperature is desired. Therefore, performance requested of the heater drive circuit is control at high indicated power (at a high duty ratio (50 to 100%) in PWM control) so as to lessen a temperature ripple of the fixation temperature for each time of printing. Therefore, in the printing mode, the first heater drive circuit (first circuit) is selected as the heater drive circuit.

Figure 6:
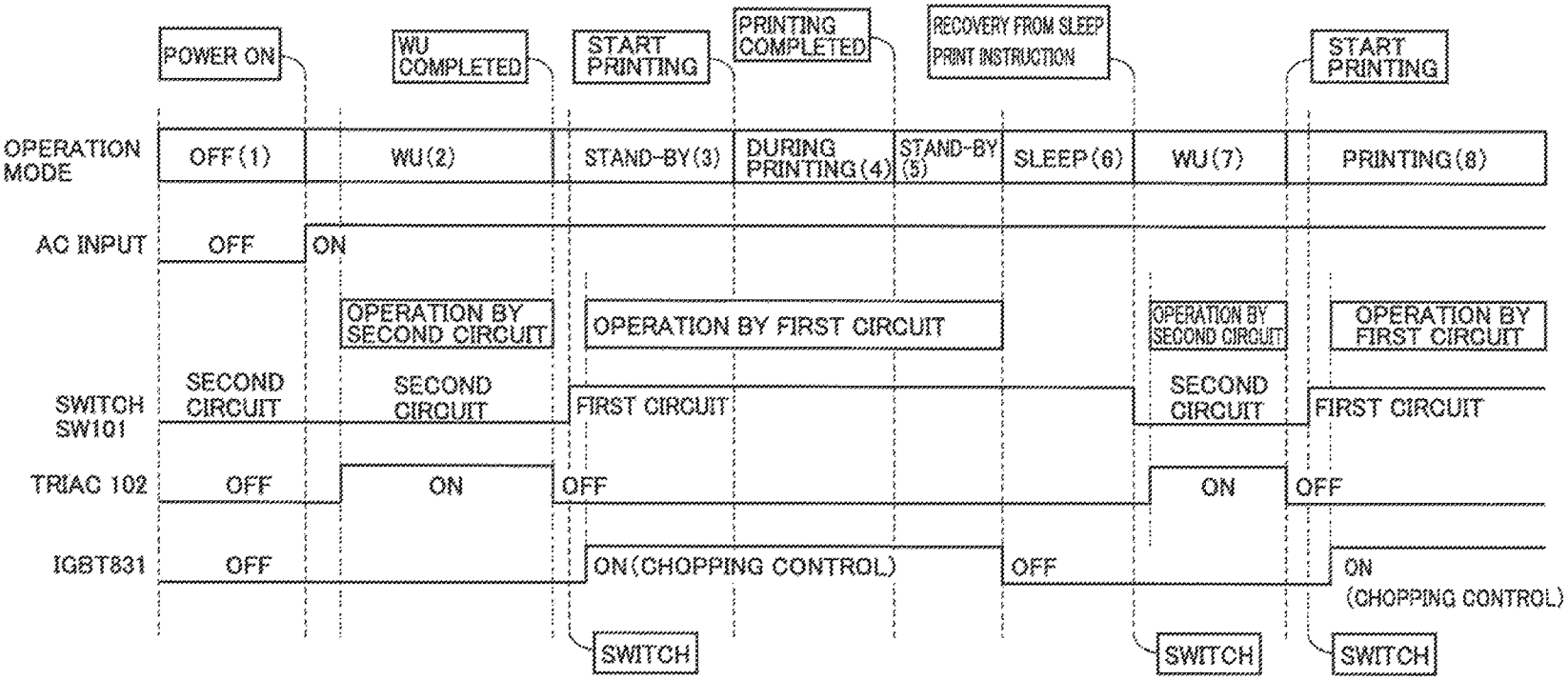
FIG. 6 is a timing chart for illustrating an operation to switch between heater drive circuits.

An operation to switch between heater drive circuits with change in operation mode will now be described. FIG. 6 is a timing chart for illustrating an operation to switch between the heater drive circuits. Initially, power of image forming apparatus 1 has been turned off and the operation mode is off (1). Therefore, when the operation mode is off (1), control unit 7 controls an input of the commercial power supply (AC input) to be turned off, controls switching circuit (switch SW) 101 to select the second circuit, controls triac 102 to be turned off, and controls switching element (IGBT) 831 to be turned off.

When power of image forming apparatus 1 is turned on, the operation mode makes transition to a warm-up (WU) mode (2). When the operation mode is set to the warm-up mode (2), control unit 7 turns on triac 102 with a slight delay as compared with turn-on of the input (AC input) of the commercial power supply. When triac 102 is turned on, the second circuit starts to operate because switching circuit (switch SW) 101 has selected the second circuit. As the second circuit drives heater 52 at maximum power (at a duty ratio of 100%), image forming apparatus 1 can shorten the warm-up time period (WT) with power efficiency being enhanced.

When a temperature of heater 52 reaches a stand-by target temperature (for example, 180° C.), control unit 7 stops the operation by the second circuit regarding warm-up of image forming apparatus 1 as having been completed. The second circuit is turned off by turning off triac 102. Thereafter, control unit 7 switches the operation mode from the warm-up mode (2) to the stand-by mode (3) and controls switching circuit (switch SW) 101 to select the first circuit. Timing for switching circuit (switch SW) 101 to select the first circuit is slightly delayed as compared with the timing of turn-off of triac 102. Control unit 7 turns on switching element (IGBT) 831 with a slight delay as compared with switching by switching circuit (switch SW) 101 to the first circuit. The first circuit drives heater 52 by starting high-frequency chopping control by turning on switching element (IGBT) 831 and controlling power to be supplied at indicated power at a low duty ratio (0 to 50%). Image forming apparatus 1 can thus accurately maintain a temperature of heater 52 at the stand-by temperature.

When image forming apparatus 1 starts printing, control unit 7 changes the operation mode from the stand-by mode (3) to a printing mode (4). When switching to the printing mode (4) is made, the first circuit drives heater 52 by controlling power to be supplied at indicated power at a high duty ratio (50 to 100%). Image forming apparatus 1 can thus accurately maintain the temperature of heater 52 at a fixation temperature. When switching from the stand-by mode (3) to the printing mode (4) is made, control unit 7 maintains the first circuit as the circuit to drive the heater. Therefore, control of the fixation temperature and power consumption can continue with power control with the same circuit being maintaine.

When image forming apparatus 1 completes printing, control unit 7 switches the operation mode from the printing mode (4) to the stand-by mode (5). When switching to the stand-by mode (5) is made, the first circuit drives heater 52 by controlling power to be supplied at indicated power at the low duty ratio (0 to 50%). Image forming apparatus 1 can thus accurately maintain the temperature of heater 52 at the stand-by temperature.

When the stand-by mode continues for a certain period in image forming apparatus 1, control unit 7 changes the operation mode from the stand-by mode (5) to a sleep mode (6). When switching to the sleep mode (6) is made, the first circuit stops high-frequency chopping control by turning off switching element (IGBT) 831 and output of supply of power to heater 52. Image forming apparatus 1 can thus reduce power consumption in heater 52. In the sleep mode (6), control unit 7 may allow switching circuit (switch SW) 101 to remain selecting the first circuit as shown in FIG. 6 or may control switching circuit (switch SW) 101 to select the second circuit.

When image forming apparatus 1 receives a print instruction in the sleep mode (6), control unit 7 switches the operation mode from the sleep mode (6) to the warm-up (WU) mode (7), and controls switching circuit (switch SW) 101 to select the second circuit. Timing of switching for switching circuit (switch SW) 101 to select the second circuit is earlier than the timing of turn-on of triac 102. Control unit 7 turns of triac 102 with a slight delay as compared with selection of the second circuit by switching circuit (switch SW) 101. When triac 102 is turned on, the second circuit starts to operate because switching circuit (switch SW) 101 has selected the second circuit. Image forming apparatus 1 can shorten the warm-up time period (WT) with power efficiency being enhanced, by the second circuit driving heater 52 at maximum power (at the duty ratio of 100%).

When a temperature of heater 52 reaches the fixation temperature, control unit 7 changes the operation mode from the warm-up mode (7) to the printing mode (8) and stops the operation by the second circuit by turning off triac 102. Thereafter, control unit 7 controls switching circuit (switch SW) 101 to select the first circuit. Timing of switching for switching circuit (switch SW) 101 to select the first circuit is slightly delayed as compared with the timing of turn-off of triac 102. Control unit 7 has heater 52 driven by turning on switching element (IGBT) 831 with a slight delay as compared with switching to the first circuit by switching circuit (switch SW) 101 so as to start high-frequency chopping control and controlling power to be supplied at indicated power at the high duty ratio (50 to 100%). Image forming apparatus 1 can thus accurately maintain the temperature of heater 52 at the fixation temperature.

Figure 7:
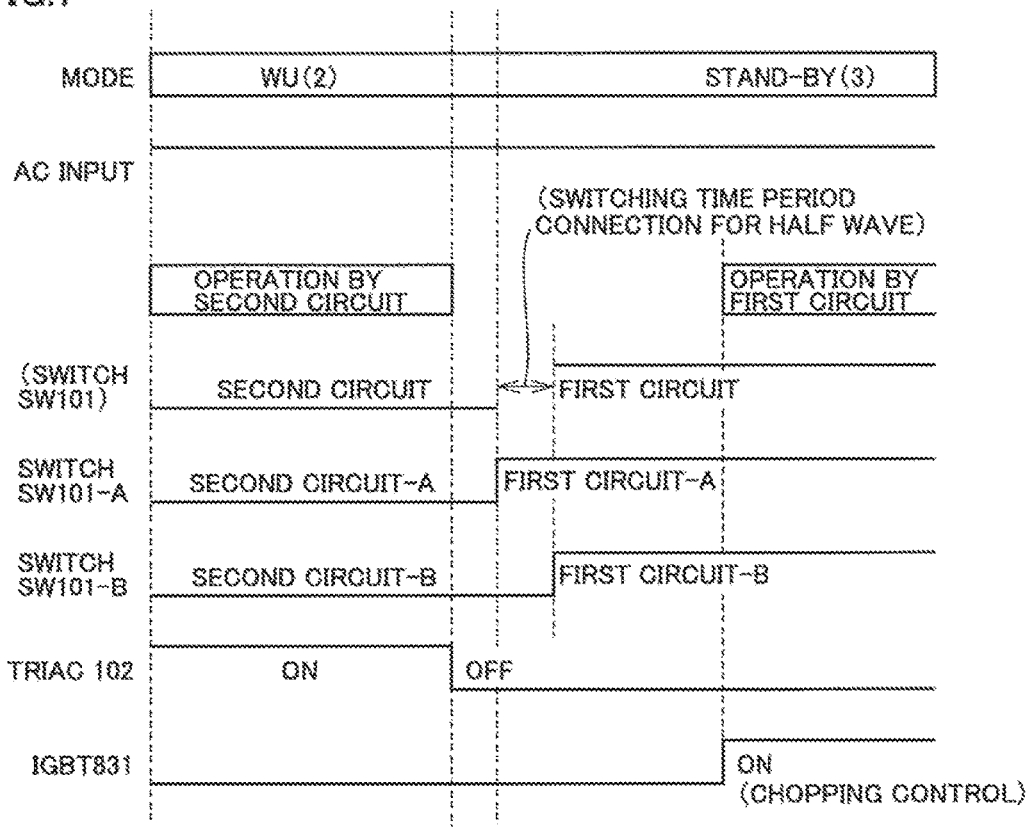
FIG. 7 is a timing chart for illustrating an operation to switch between the heater drive circuits when switching from a warm-up mode to a stand-by mode is made.

As described above, switching circuit (switch SW) 101 switches between circuits which are to drive the heater when the operation mode is changed from the warm-up mode (2) to the stand-by mode (3), from the sleep mode (6) to the warm-up mode (7), and from the warm-up mode (7) to the printing mode (8). This control will be described in further detail. FIG. 7 is a timing chart for illustrating an operation to switch between the heater drive circuits when change from the warm-up mode (2) to the stand-by mode (3) is made.

Switching circuit (switch SW) 101 is implemented by switch 101A provided at one end of heater 52 and switch 101B provided at the other end of heater 52, and they are not identical in timing of switching in a strict sense. In the timing chart shown in FIG. 7, timing of switching from the second circuit to the first circuit by switch 101A is not identical to the timing of switching from the second circuit to the first circuit by switch 101B, and switch 101A makes switching earlier.

A time period during which switch 101A has selected the first circuit but switch 101B still maintains selection of the second circuit is referred to as a switching time period. In this switching time period, the commercial power supply and heater 52 are connected to each other by a half wave and the switching time period will be a cause of a power loss in heater 52. Therefore, control unit 7 should minimize the switching time period so as to minimize a loss due to the switching time period in consideration of delay in opening and closing of contacts of switches 101A and 101B.

Figure 8:
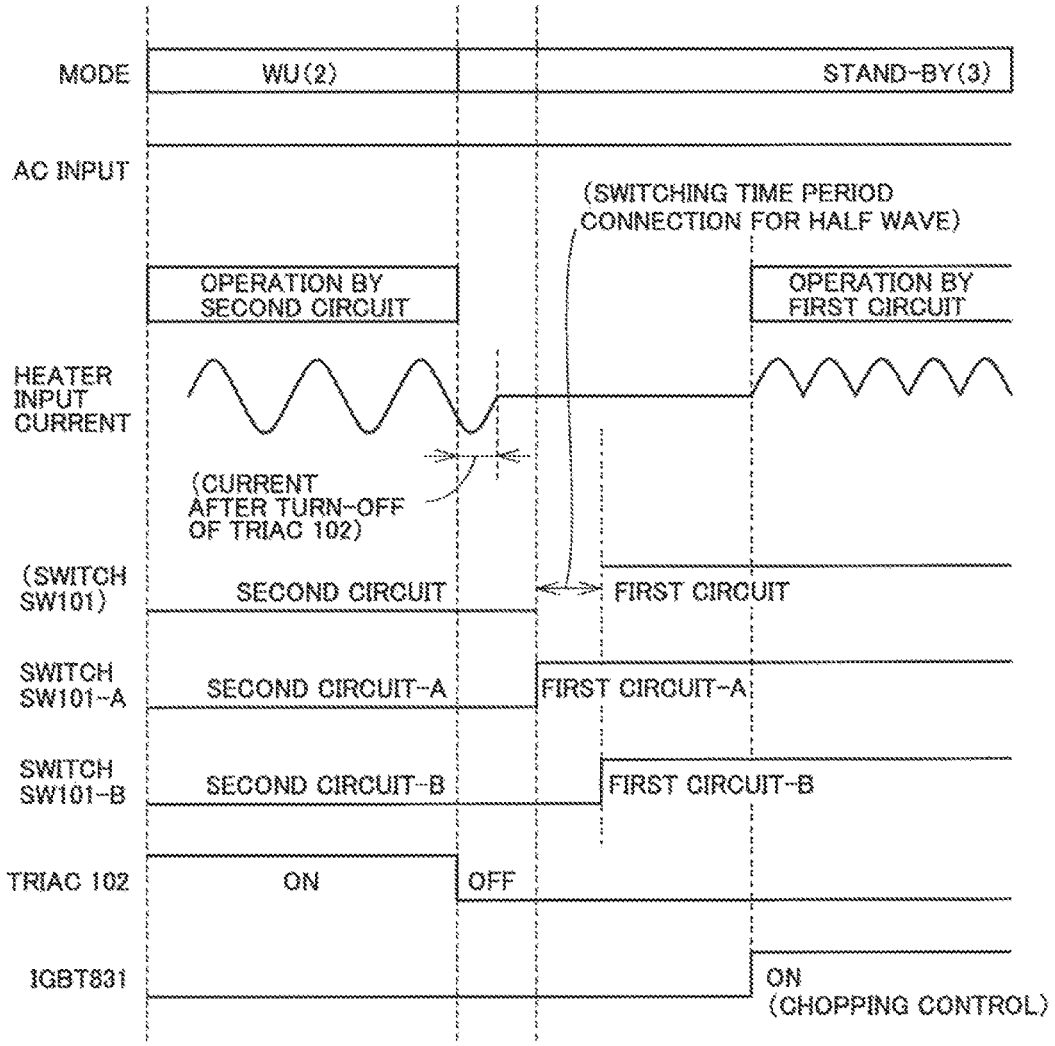
FIG. 8 is a timing chart for illustrating a switching operation by a triac and a switching circuit.

A switching operation by triac 102 and switching circuit (switch SW) 101 will now be described. FIG. 8 is a timing chart for illustrating a switching operation by triac 102 and switching circuit (switch SW) 101. The second circuit is provided with triac 102 in AC line 84B as shown in FIG. 2. Triac 102 has such characteristics that it does not stop conduction of power to heater 52 immediately after it is turned off, and a post-turn-off current flows through heater 52 after the triac is turned off as shown in FIG. 8. A time period during which the post-turn-off current flows through heater 52 is comparable to approximately half a cycle of the commercial power supply. Therefore, when control unit 7 controls switching circuit (switch SW) 101 to select the first circuit simultaneously with turn-off of triac 102, the current in the second circuit flows to the first circuit. Then, when control unit 7 controls switching circuit (switch SW) 101 to select the first circuit, the control unit should control the switching circuit to switch to the first circuit after lapse of a half cycle of the commercial power supply since turn-off of triac 102.

Specifically, when the commercial power supply is at 50 Hz, 10 ms is necessary for power conduction to heater 52 to stop from the off state of triac 102, and when the commercial power supply is at 60 Hz, 8.4 ms is necessary for power conduction to heater 52 to stop from the off state of triac 102. Therefore, when control unit 7 controls switching from the second circuit to the first circuit, it controls switching to the first circuit after lapse of 10 ms or longer since the off state of triac 102. Short-circuiting due to switching from the second circuit to the first circuit can thus be prevented.

Timing of switching by switching circuit (switch SW) 101 may be determined by providing a zero-cross detection circuit and making determination based on whether or not the zero-cross detection circuit has detected zero-crossing of triac 102, in addition to making determination as to whether or not a half cycle of the commercial power supply has elapsed since the off state of triac 102. Namely, when control unit 7 controls switching from the second circuit to the first circuit, it controls switching to the first circuit after timing of zero-crossing of the triac detected by a zero-cross detection portion. Short-circuiting due to switching from the second circuit to the first circuit can thus be prevented.

Though timing of switching from the second circuit to the first circuit by switching circuit (switch SW) 101 has been described above, in connection also with timing of switching from the first circuit to the second circuit, timing of switching element (IGBT) 831 in the first circuit may be taken into consideration. For example, control unit 7 controls switching to the second circuit after lapse of 5 μs or longer (with one cycle of chopping at 20 kHz being assumed) since turn-off of switching element (IGBT) 831 in the first circuit. Namely, control unit 7 stands by for a period until a potential of the first circuit attains to a prescribed potential or lower, and then has the second circuit drive the heater. Short-circuiting due to switching from the first circuit to the second circuit can thus be prevented.

Though control for selecting any of the first circuit and the second circuit with switching circuit (switch SW) 101 depending on the operation mode has been described above, control for selecting any of the first circuit and the second circuit in consideration also of a condition other than the operation mode will be described. FIG. 9 is a diagram for illustrating switching between the heater drive circuits based on a duty ratio (Duty) of indicated power.

In FIG. 9, when the duty ratio (Duty) of indicated power is 100%, control unit 7 regards the operation mode as being set to the warm-up mode and selects the second circuit with switching circuit (switch SW) 101. When the duty ratio (Duty) of indicated power is from 50 to 80%, control unit 7 regards the operation mode as being set to the normal printing mode and selects the first circuit with switching circuit (switch SW) 101. When the duty ratio (Duty) of indicated power is from 0 to 50%, control unit 7 regards the operation mode as being set to the normal stand-by mode, and selects the first circuit with switching circuit (switch SW) 101.

When the duty ratio (Duty) of indicated power is from 95 to 100%, control unit 7 regards the operation mode as being set to a successive printing mode and selects the first circuit with switching circuit (switch SW) 101. In particular, when color printing on cardboard is successively done at a high speed in an extremely low temperature environment, heat of a fixation roller is absorbed by the cardboard and a temperature of heater 52 greatly varies. Therefore, control unit 7 should repeat control at the duty ratio (Duty) of 100% and the duty ratio (Duty) lower than 100%. Switching to the second circuit each time of drive at the duty ratio (Duty) of 100%, however, leads to increase in switching loss. Therefore, in the successive printing mode, control unit 7 maintains selection of the first circuit regardless of variation in duty ratio (Duty) of indicated power.

Similarly, when control unit 7 does not receive a print instruction and the duty ratio (Duty) of indicated power is from 95 to 100%, the control unit regards the operation mode as being set to a continuous stand-by mode and selects the first circuit with switching circuit (switch SW) 101. In particular, during continuous stand-by in an extremely low temperature environment, a temperature of heater 52 greatly varies. Therefore, control unit 7 should repeat control at the duty ratio (Duty) of 100% and the duty ratio (Duty) lower than 100%. Switching to the second circuit each time of drive at the duty ratio (Duty) of 100%, however, leads to increase in switching loss. Therefore, in the continuous stand-by mode, control unit 7 maintains selection of the first circuit regardless of variation in duty ratio (Duty) of indicated power.

Even in the continuous stand-by mode, when there is an allowance to some extent (a temperature ripple is allowed) during a time period for recovery from stand-by from the stand-by mode to the printing mode with energy saving being prioritized, control unit 7 may select the second circuit with switching circuit (switch SW) 101 for driving the heater at the duty ratio (Duty) of 100%.

Control for switching between the heater drive circuits based on a detected temperature of heater 52 will now be described. FIG. 10 is a diagram for illustrating switching between the heater drive circuits based on a detected temperature of heater 52. FIG. 10 shows a temperature of heater 52 detected by temperature detection portion 54 (detected temperature), the operation mode, a warm-up completion temperature (WU completion temperature), and a selected circuit. Control unit 7 selects any of the first circuit and the second circuit based on a temperature of heater 52 detected by temperature detection portion 54 upon receiving a print instruction. When switching from the second circuit to the first circuit is made, heater 52 should once be turned off (for example, for several ten milliseconds) and hence a slight power loss is caused. Therefore, when warm-up is started from such a state that a temperature of heater 52 is as low as approximately 30° C., selection of the second circuit can enhance power efficiency. When warm-up is started from such a state that a temperature of heater 52 is as high as approximately 170° C. to the contrary, a power loss due to switching between circuits is great.

In FIG. 10, control unit 7 selects the second circuit when the detected temperature is not higher than 160° C. and selects the first circuit when the detected temperature is higher than 160° C. Though switching between circuits with 160° C. being defined as a threshold value is described, the threshold value at 160° C. is by way of example and the threshold value may be modified depending on an input voltage of a power supply or an ambient temperature. Control unit 7 may count time from turn-off of heater 52 until next turn-on and may select any of the first circuit and the second circuit based on the counted time. Specifically, when a time period from previous turn-off of heater 52 until next turn-on is within a prescribed period (for example, 60 s), a temperature of heater 52 is relatively high and control unit 7 selects the first circuit. When the time period is longer than the prescribed period, a temperature of heater 52 is relatively low and control unit 7 selects the second circuit.

Control unit 7 may count a duration of the stand-by mode (a stand-by duration) and may select any of the first circuit and the second circuit based on the counted duration. Specifically, when the duration of the stand-by mode is equal to or shorter than a prescribed reference (for example, 1 h), control unit 7 selects the first circuit regarding a temperature of heater 52 as being maintained at a relatively high temperature, and when the duration is longer than the prescribed reference, the control unit selects the second circuit regarding a temperature of heater 52 as having been lowered.

Control for switching between the heater drive circuits based on a difference between a detected temperature of heater 52 and a warm-up completion temperature will now be described. FIG. 11 is a diagram for illustrating switching between the heater drive circuits based on a difference between a detected temperature of heater 52 and a warm-up completion temperature. FIG. 11 shows a temperature of heater 52 detected by temperature detection portion 54 (detected temperature), the operation mode, a warm-up completion temperature (WU completion temperature), a difference between the WU completion temperature and the detected temperature (WU completion—detected temperature), and a selected circuit. Control unit 7 selects any of the first circuit and the second circuit based on a difference between a temperature of heater 52 detected by temperature detection portion 54 upon receiving a print instruction and a warm-up completion temperature in the print instruction. The warm-up completion temperature is different between color printing and monochrome printing in the print instruction. A circuit to be selected will be different if a warm-up completion temperature is different in spite of a temperature of heater 52 being the same.

In FIG. 11, when a difference between the WU completion temperature and the detected temperature is equal to or greater than 20° C., control unit 7 selects the second circuit, and when a difference between the WU completion temperature and the detected temperature is smaller than 20° C., control unit 7 selects the first circuit. Though switching between circuits with a temperature difference of 20° C. (a prescribed value) being defined as a threshold value is described, the temperature difference of 20° C. is by way of example, and the temperature difference may be modified depending on an input voltage of the power supply or an ambient temperature. The setting of the warm-up completion temperature (WU completion temperature) may be modified in consideration of a condition of warming of image forming apparatus 1 or a type of printing paper.

In the timing chart shown in FIG. 6, when a temperature of heater 52 reaches a stand-by target temperature (for example, 180° C.), control unit 7 is described to stop operations by the second circuit and controls switching circuit (switch SW) 101 to select the first circuit. Namely, control unit 7 controls the switching circuit to select the second circuit until a temperature of heater 52 reaches the stand-by target temperature so as to increase the temperature of heater 52 to the stand-by target temperature in a shortest period of time with productivity being prioritized (a productivity mode (a non-energy-saving mode)). The control unit, however, may control the switching circuit to change the drive circuit from the second circuit to the first circuit before a temperature of heater 52 attains to the stand-by target temperature with energy saving of image forming apparatus 1 being prioritized (an energy saving mode). A user of image forming apparatus 1 may be allowed to select between the productivity mode and the energy saving mode through operation/input portion 6.

Figure 12:
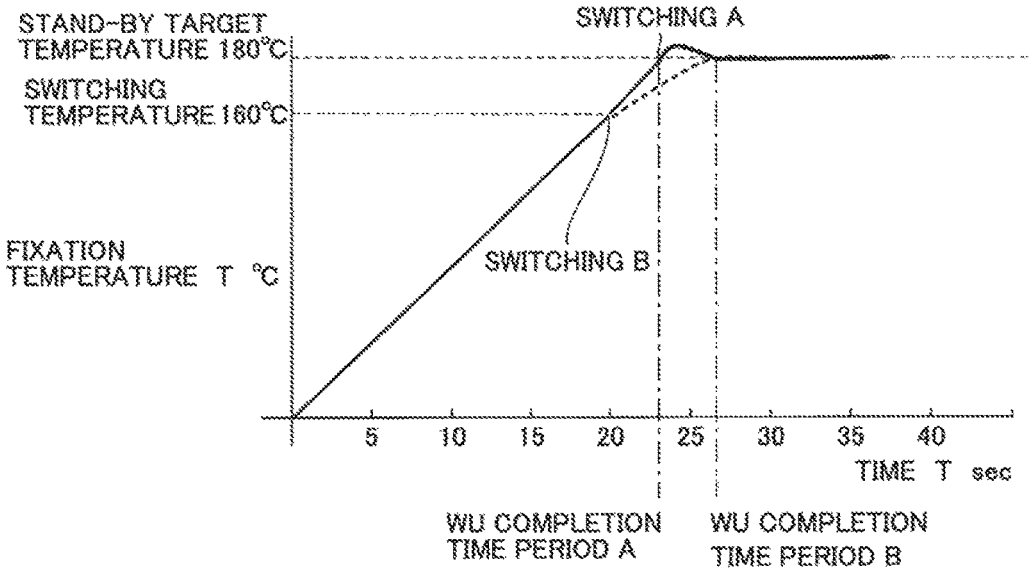
FIG. 12 is a diagram for illustrating relation between a detected temperature and timing of change from a second circuit to a first circuit.

FIG. 12 is a diagram for illustrating relation between a detected temperature and timing of change from the second circuit to the first circuit. The ordinate shown in FIG. 12 represents a temperature of heater 52 detected by temperature detection portion 54 (detected temperature) and the abscissa represents time. When a temperature of heater 52 is increased in a shortest period of time to a stand-by target temperature with productivity being prioritized, a WU completion time period A until reaching the stand-by target temperature (for example, 180° C.) is approximately 23 seconds. Since change from the second circuit to the first circuit is made at timing (switching A) when the temperature of heater 52 reaches the stand-by target temperature (a first prescribed temperature), the temperature of heater 52 overshoots the stand-by target temperature and a temperature ripple is great. Thereafter, control unit 7 controls power to be supplied to heater 52 by the first circuit to bring the temperature closer to the stand-by target temperature.

When heating to the stand-by target temperature is performed with energy saving being prioritized, change from the second circuit to the first circuit is made at timing (switching B) when a switching temperature (a second prescribed temperature) lower than the stand-by target temperature is reached. Therefore, increase in temperature of heater 52 is suppressed after switching to the first circuit and a WU completion time period B until reaching the stand-by target temperature (for example, 180° C.) is increased to approximately 27 seconds. By suppressing increase in temperature to the stand-by target temperature, however, a temperature ripple can be lessened without overshooting the stand-by target temperature, and energy saving in image forming apparatus 1 can be achieved. The switching temperature is set, for example, to 160° C.

As set forth above, in image forming apparatus 1 according to the present embodiment, control unit 7 can control switching circuit 101 to set the drive circuit for driving heater 52 to any one of the first heater drive circuit and the second heater drive circuit. Therefore, in image forming apparatus 1, by having switching circuit 101 appropriately switch between the heater drive circuits, influence by the drawback of each heater drive circuit can be lessened.

In image forming apparatus 1, switching circuit 101 to switch between the drive circuits is provided between heater 52 and the first heater drive circuit and between heater 52 and the second heater drive circuit. In image forming apparatus 1, switching circuit 101 (switches 101A and 101B) is provided at each of opposing ends of heater 52. Therefore, in image forming apparatus 1, switching between a plurality of drive circuits for heater 52 can reliably be made.

Switching circuit 101 is not limited to such a construction that it is provided between heater 52 and the first heater drive circuit and between heater 52 and the second heater drive circuit and is provided at each of opposing ends of heater 52. Any construction is applicable so long as switching between the first heater drive circuit and the second heater drive circuit which are to be connected to heater 52 can be made.

Control unit 7 may control switching between the drive circuits by switching circuit 101 depending on an operation mode of image forming apparatus 1. In particular, when the operation mode is set to the printing (image formation) mode and the stand-by mode, control unit 7 may control switching circuit 101 to select the first heater drive circuit for driving heater 52, and when the operation mode is set to the warm-up mode, control unit 7 may control switching circuit 101 to select the second heater drive circuit for driving heater 52*h* Image forming apparatus 1 can thus select a drive circuit to drive heater 52 depending on the operation mode, shorten a warm-up time period (WT) with power efficiency being enhanced, and reduce a temperature ripple.

When control unit 7 controls one switch 101A of switches 101A and 101B provided at opposing ends of heater 52 to switch between the drive circuits, it may control also the other switch 101B to switch between the drive circuits within a prescribed time period. A power loss in heater 52 can thus be reduced by minimizing a loss due to a switching time period of switches 101A and 101B.

When control unit 7 controls one switch 101A of switches 101A and 101B provided at the opposing ends of heater 52 to switch between the drive circuits, it may control also the other switch 101B to switch between the drive circuits at the identical timing. A power loss in heater 52 can thus be reduced by eliminating a loss due to a switching time period of switches 101A and 101B.

When the first heater drive circuit drives the heater at a duty ratio of 100%, control unit 7 may control switching circuit 101 to select the second heater drive circuit. Image forming apparatus 1 can thus shorten the warm-up time period (WT) with power efficiency being enhanced.

When processing for successively forming images is performed, control unit 7 may control switching circuit 101 to select the first heater drive circuit without selecting the second heater drive circuit. Image forming apparatus 1 can thus reduce a switching loss in the drive circuit.

During stand-by, control unit 7 may control switching circuit 101 to select the first heater drive circuit without selecting the second heater drive circuit. Image forming apparatus 1 can thus reduce a switching loss in the drive circuit.

When control unit 7 controls switching circuit 101 to change the drive circuit from the first heater drive circuit to the second heater drive circuit, it may set timing to drive the heater with the second heater drive circuit to come after a potential of the first heater drive circuit is equal to or lower than a prescribed potential. Image forming apparatus 1 can thus prevent short-circuiting due to switching from the first heater drive circuit to the second heater drive circuit.

When a temperature detected by temperature detection portion 54 is higher than a prescribed threshold value (for example, 160° C.), control unit 7 may control switching circuit 101 to select the first heater drive circuit, and when the detected temperature is equal to or lower than the prescribed threshold value, it may control switching circuit 101 to select the second heater drive circuit. Image forming apparatus 1 can thus reduce a power loss by switching between the circuits based on the detected temperature.

When a time period from previous turn-off of heater 52 until next turn-on thereof is equal or shorter than a prescribed period (for example, 60 s), control unit 7 may control switching circuit 101 to select the first heater drive circuit, and when the time period is longer than the prescribed period, control unit 7 may control switching circuit 101 to select the second heater drive circuit. Image forming apparatus 1 can thus control switching between the drive circuits without detecting a temperature of heater 52.

When a productivity mode is selected (when an energy saving mode is not selected), control unit 7 does not allow switching circuit 101 to select the first circuit until a temperature of heater 52 reaches a stand-by target temperature in the warm-up mode. When the energy saving mode is selected, control unit 7 does not allow switching circuit 101 to select the first circuit until a temperature of heater 52 reaches a switching temperature in the warm-up mode. Image forming apparatus 1 can thus select between the productivity mode and the energy saving mode in response to a request from a user.

When a difference between a temperature detected by temperature detection portion 54 and a warm-up completion temperature is smaller than a prescribed value (for example, 20° C.), control unit 7 may control switching circuit 101 to select the first heater drive circuit, and when a difference between the detected temperature and the warm-up completion temperature is equal to or greater than the prescribed value, control unit 7 may control switching circuit 101 to select the second heater drive circuit. Image forming apparatus 1 can thus reduce a power loss by switching between the circuits based on a difference between the detected temperature and the warm-up completion temperature.

When a duration of the stand-by mode (a stand-by duration) is equal to or shorter than a prescribed reference (for example, 1 h), control unit 7 may control switching circuit 101 to select the first heater drive circuit, and when the duration of the stand-by mode is longer than the prescribed reference, control unit 7 may control switching circuit 101 to select the second heater drive circuit. Image forming apparatus 1 can thus control switching between the drive circuits without detecting a temperature of heater 52.

<Modification>

Selection of any of the first circuit and the second circuit based on a time period from previous turn-off of heater 52 until next turn-on thereof or a duration of the stand-by mode (a stand-by duration) has been described in the embodiment. Limitation thereto, however, is not intended, and for example, a time period from entry into the sleep mode until cancellation of the sleep mode (a duration of the energy saving mode) may be counted and any of the first circuit and the second circuit may be selected based on the counted time.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus comprising:

a heater;

a first heater drive circuit which rectifies AC power from an AC power supply and subjects a current to be conducted to the heater to PWM control;

a second heater drive circuit which allows conduction from the AC power supply to the heater;

a switching circuit which sets a drive circuit which is to drive the heater to any one of the first heater drive circuit and the second heater drive circuit; and a control unit which controls switching between the drive circuits by the switching circuit.

2. The image forming apparatus according to claim 1, wherein the switching circuit is provided between the heater and the first heater drive circuit and between the heater and the second heater drive circuit.

3. The image forming apparatus according to claim 2, wherein the switching circuit is provided at each of opposing ends of the heater.

4. The image forming apparatus according to claim 1, wherein the control unit controls switching between the drive circuits by the switching circuit in accordance with an operation mode of the image forming apparatus, when the operation mode is set to an image formation mode and a stand-by mode, the switching circuit is controlled to select the first heater drive circuit for driving the heater, and when the operation mode is set to a warm-up mode, the switching circuit is controlled to select the second heater drive circuit for driving the heater.

5. The image forming apparatus according to claim 3, wherein when the control unit controls one switching circuit of the switching circuits provided at the opposing ends of the heater to switch between the drive circuits, the control unit controls also the other switching circuit to switch between the drive circuits within a prescribed period of time.

6. The image forming apparatus according to claim 3, wherein when the control unit controls one switching circuit of the switching circuits provided at the opposing ends of the heater to switch between the drive circuits, the control unit controls also the other switching circuit to switch between the drive circuits at identical timing.

7. The image forming apparatus according to claim 1, wherein when the first heater drive circuit drives the heater such that a duty ratio in the PWM control is set to 100%, the control unit controls the switching circuit to select the second heater drive circuit.

8. The image forming apparatus according to claim 7, wherein when processing for successively forming images is performed, the control unit controls the switching circuit to select the first heater drive circuit without selecting the second heater drive circuit.

9. The image forming apparatus according to claim 7, wherein during stand-by, the control unit controls the switching circuit to select the first heater drive circuit without selecting the second heater drive circuit.

10. The image forming apparatus according to claim 1, wherein when the control unit controls the switching circuit to change the drive circuit from the first heater drive circuit to the second heater drive circuit, the control unit sets timing to drive the heater with the second heater drive circuit to come after a potential of the first heater drive circuit is equal to or lower than a prescribed potential.

11. The image forming apparatus according to claim 1, wherein the second heater drive circuit further includes a triac for controlling whether to conduct the AC power to the heater.

12. The image forming apparatus according to claim 11, wherein when the control unit controls the switching circuit to change the drive circuit from the second heater drive circuit to the first heater drive circuit, the control unit controls switching to the first heater drive circuit after lapse of a half cycle of a frequency of the AC power since an off state of the triac for conducting from the second heater drive circuit to the heater.

13. The image forming apparatus according to claim 11, the image forming apparatus further comprising a zero-cross detection portion which detects timing of zero-crossing of the triac, wherein when the control unit controls the switching circuit to change the drive circuit from the second heater drive circuit to the first heater drive circuit, the control unit controls switching to the first heater drive circuit after timing of zero-crossing of the triac detected by the zero-cross detection portion.

14. The image forming apparatus according to claim 1, the image forming apparatus further comprising a temperature detection portion which detects a temperature of the heater, wherein when a temperature detected by the temperature detection portion is higher than a prescribed threshold value, the control unit controls the switching circuit to select the first heater drive circuit, and when a temperature detected by the temperature detection portion is equal to or lower than the prescribed threshold value, the control unit controls the switching circuit to select the second heater drive circuit.

15. The image forming apparatus according to claim 1, the image forming apparatus further comprising a time counting portion which counts a time period from a previous off state of the heater to a next on state of the heater, wherein when the time period counted by the time counting portion is equal to or shorter than a prescribed time period, the control unit controls the switching circuit to select the first heater drive circuit, and when the time period counted by the time counting portion is longer than the prescribed time period, the control unit controls the switching circuit to select the second heater drive circuit.

16. The image forming apparatus according to claim 4, the image forming apparatus further comprising a selection portion with which a user selects whether to set an energy saving mode, wherein when the energy saving mode is not selected with the selection portion, the control unit does not allow the switching circuit to select the first heater drive circuit until a temperature of the heater reaches a first prescribed temperature in the warm-up mode, and when the energy saving mode is selected with the selection portion, the control unit does not allow the switching circuit to select the first heater drive circuit until a temperature of the heater reaches a second prescribed temperature lower than the first prescribed temperature in the warm-up mode.

17. The image forming apparatus according to claim 4, the image forming apparatus further comprising:

a temperature detection portion which detects a temperature of the heater; and a setting unit which sets a set temperature of the heater after the warm-up mode, wherein the control unit controls the switching circuit to select the first heater drive circuit when a difference between the temperature detected by the temperature detection portion and the set temperature is smaller than a prescribed value, and the control unit controls the switching circuit to select the second heater drive circuit when a difference between the temperature detected by the temperature detection portion and the set temperature is equal to or greater than the prescribed value.

18. The image forming apparatus according to claim 1, the image forming apparatus further comprising a stand-by duration counting portion which counts a stand-by duration from start of stand-by until end of stand-by, wherein when the stand-by duration counted by the stand-by duration counting portion is equal to or shorter than a prescribed reference, the control unit controls the switching circuit to select the first heater drive circuit, and when the stand-by duration counted by the stand-by duration counting portion is longer than the prescribed reference, the control unit controls the switching circuit to select the second heater drive circuit.

* * * * *